US005302784A

United States Patent [19]

Perret

[11] Patent Number: 5,302,784

[45] Date of Patent: Apr. 12, 1994

[54] CIRCUIT BREAKER INERTIA CONTACT ASSEMBLY FOR RESISTANCE INSERTION DURING OPENING AND CLOSING OPERATIONS

[75] Inventor: Michel Perret, Bourgoin-Jallieu, France

[73] Assignee: GEC Alsthom T&D SA, Paris, France

[21] Appl. No.: 29,053

[22] Filed: Mar. 9, 1993

[30] Foreign Application Priority Data

Mar. 10, 1992 [FR] France ..... 92 02837

[51] Int. Cl.[5] ..... H01H 33/16; H01H 33/90

[52] U.S. Cl. ..... 200/144 AP; 200/148 A; 200/148 B

[58] Field of Search ..... 200/144 AP, 148 A, 148 R, 200/148 B

[56] References Cited

FOREIGN PATENT DOCUMENTS 0157922 10/1985 European Pat. Off. .
0461629 12/1991 European Pat. Off. .
2450501 9/1980 France .

OTHER PUBLICATIONS

Patent Abstracts of Japan, vol. 015, No. 284 (E-1091) Jul. 18, 1991 & JP-A-31 01 025 (Toshiba) Apr. 25, 1991.

*Primary Examiner*—J. R. Scott
*Attorney, Agent, or Firm*—Sughrue, Mion, Zinn, Macpeak & Seas

[57] ABSTRACT

An inertia contact designed to co-operate with a contact in series with a component, such as a resistor or a varistor, is disposed in the interrupting chamber of a circuit-breaker so as to be inserted in parallel with the contacts of the circuit-breaker for a limited period of time. The circuit-breaker includes a tube supporting moving contacts and connected to a drive rod. The inertia contact comprises a circularly-symmetrical metal casing coaxial with the tube and surrounding the tube. The casing is substantially tubular in shape with a projection flanked by two rings fitting snugly and slidably against the tube. A first end of the inertia contact is made of an alloy that is resistant to the effects of arcing. A second end of the inertia contact serves to fix the inertia contact to a first end of at least one spring. A second end of the spring is fixed to the tube. A band having a conical inside cross-section is disposed at one end of the cavity formed by the projection and the tube engages a domed collar fixed to the tube to damp the shock during relative motion of the inertia contact and the tube during contact therebetween as a result of circuit-breaker opening.

8 Claims, 2 Drawing Sheets

56
55
54
53
51A
57
58
50B
50C
13
51
50A
50
62
61
60
52
31A
31
14
50A'
64

CIRCUIT BREAKER INERTIA CONTACT ASSEMBLY FOR RESISTANCE INSERTION DURING OPENING AND CLOSING OPERATIONS

The present invention relates to an inertia contact.

BACKGROUND OF THE INVENTION

The invention may be used, in particular, in high-tension circuit-breakers of the type in which a resistor or a varistor is inserted in parallel with the terminals of the arcing contacts for a relatively short period of time on circuit-breaker opening or on circuit-breaker closing.

Contact apparatus for such insertion is described in French Patent Application No. 91 06159, filed in the name of the Applicant. FIG. 1 of the present specification reproduces FIG. 1 of the above-mentioned document. FIG. 1 shows a circuit-breaker interrupting chamber comprising a gastight ceramic casing 1 delimiting a volume 2 filled with a gas under pressure and having good dielectric properties. The casing, which is closed at its top by a metal end plate 3, contains a fixed assembly comprising a first metal tube 6 constituting the fixed main contact, a second metal tube 7 constituting the fixed arcing contact, and contact fingers 31 connected to one end 20 of a varistor made up of a stack of disks 18 disposed in an insulating cylinder 19. The ends 31A of the arms 31 are made of an alloy that is resistant to the effects of electric arcing. The second end of the varistor, together with the fixed permanent contacts and the fixed arcing contacts are electrically connected via arms 5 to a first current terminal 4 of the circuit-breaker.

The moving assembly of the circuit-breaker comprises a cylinder 9 mechanically connected to a drive rod (not shown) and electrically connected to a second current terminal (not shown). A part 11 is fixed to the cylinder 9 and serves as a support for the fingers 12 constituting the moving permanent contact, for the fingers 14 constituting the moving arcing contact and disposed at the end of a tube 13, and for a blast nozzle 17. A cap 10 protects the fingers 12 from corona discharge. Holes 15 are provided in the part 11 to enable the blast gas to pass therethrough. The varistor is inserted in parallel with the arcing contacts on circuit-breaker opening by means of an inertia contact 43 in the form of a rod which is slidably mounted in a guide block 30 fixed to the cylinder 9, and which is provided with a cavity 32 in which the first end of a spring 34 surrounding the rod 43 bears, the other end of the spring abutting against a damping block 40 fixed to the end of the rod.

When the circuit-breaker opens, by means of the moving equipment being displaced, the rod 43 because of its inertia, remains stationary for a few instants against the pressure of the spring which is compressed. This enables the varistor to be inserted after the arcing contacts have moved apart, the varistor being inserted for the length of time required to attenuate any voltage surges. When the spring is fully compressed, the rod 43 is driven by the motion of the cylinder 9 and it moves away from the contact 31.

These dispositions also enable the varistor to be inserted on circuit-breaker closing, before the arcing contacts come together, by means of an appropriate choice of contact lengths.

The dielectric profile of the above-described apparatus is not suitable for very high tension equipment.

OBJECTS AND SUMMARY OF THE INVENTION

An object of the present invention is to provide a set of contacts including an inertia contact having an advantageous dielectric profile.

Another object of the invention is to provide a set of such contacts that are compact, in particular in the axial direction, and that fit into an interrupting chamber without it being necessary to increase the dimensions thereof, and in particular the diameter thereof.

The invention provides an inertia contact designed to engage with a contact in series with a component, such as a resistor or a varistor, disposed in the interrupting chamber of a circuit-breaker so as to be inserted in parallel with the contacts of the circuit-breaker for a limited period of time. The circuit-breaker includes a tube supporting moving contacts and connected to a drive rod, wherein the inertia contact comprises a circularly-symmetrical metal casing coaxial with the tube and surrounding it. The casing is substantially tubular in shape with a projection flanked by two rings fitting snugly against the tube. A first end of the inertia contact is made of an alloy that is resistant to the effects of arcing. A second end of the inertia contact serves to fix the inertia contact to a first end of at least one spring. The second end of the spring is fixed to the tube. A band having a conical inside cross-section is disposed at one end of a cavity formed by the projection and the tube and engagable with a domed collar fixed to the tube to damp the impact between the collar and the band upon termination of relative motion of the inertia contact and the tube, during circuit-breaker opening.

Advantageously, the inertia contact includes three parallel springs disposed at 120 degrees from one another.

The domed collar carries two O-rings disposed in planes that are perpendicular to the axis of the insertion contact.

Preferably, the O-rings are made of elastomer.

The band is preferably made of a synthetic material such as polytetrafluoroethylene (PTFE).

Advantageously the metal casing constituting the inertia contact is made in two portions which are screwed together.

In this case, the band is clamped between a step constituted by one of the portions and a sealing ring bearing against the end of the cavity delimited by the projection and the tube.

Advantageously, said sealing ring is made of elastomer.

BRIEF DESCRIPTION OF THE DRAWINGS

An embodiment of the invention is described by way of example with reference to the accompanying drawings, in which.

DETAILED DESCRIPTION

Figure 1:
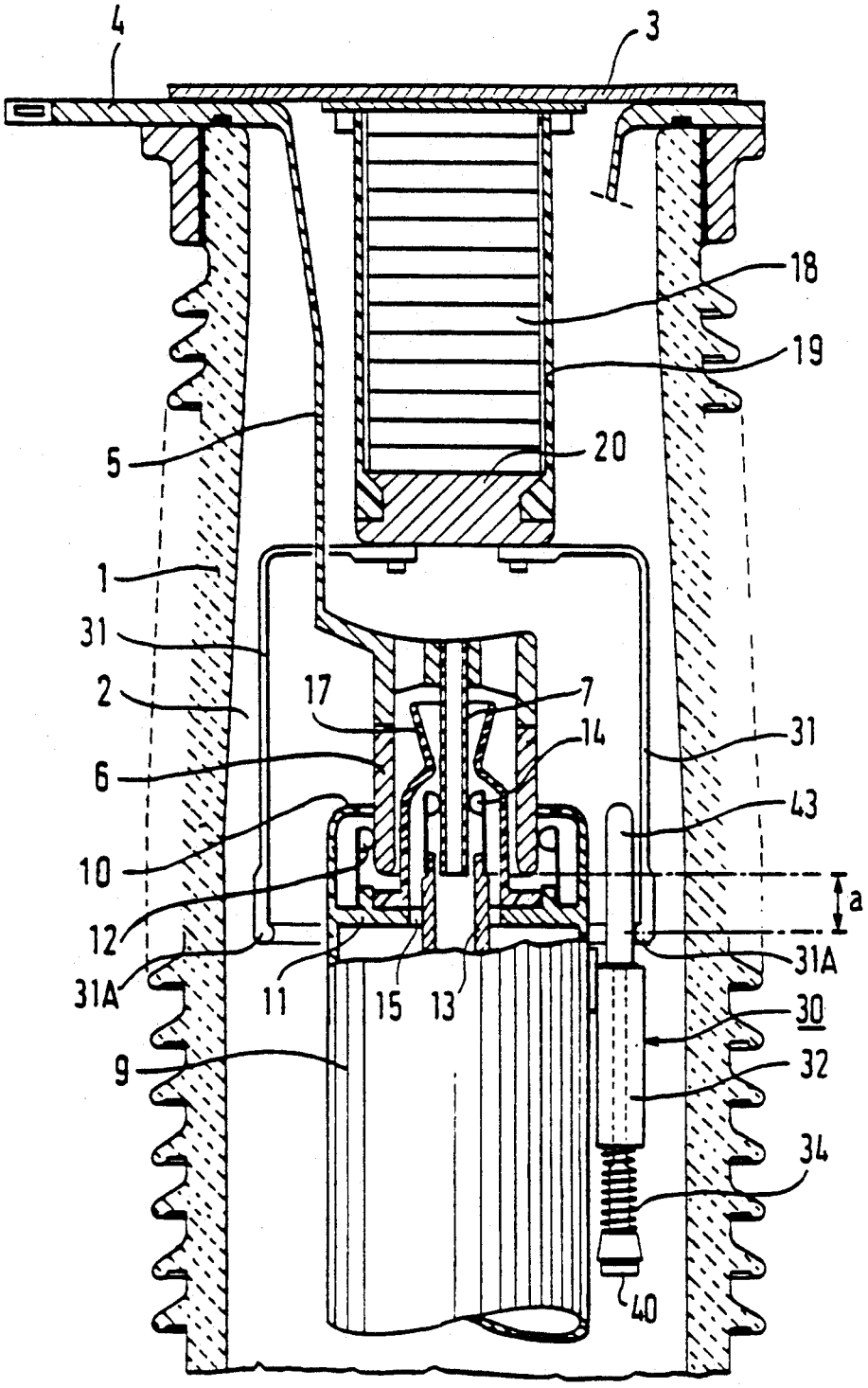
FIG. 1 PRIOR ART
FIG. 1 is a diagrammatic axial section through an interrupting chamber of a high-tension circuit-breaker equipped with a device for inserting a varistor.
Figures 2, 3, 4, 5:
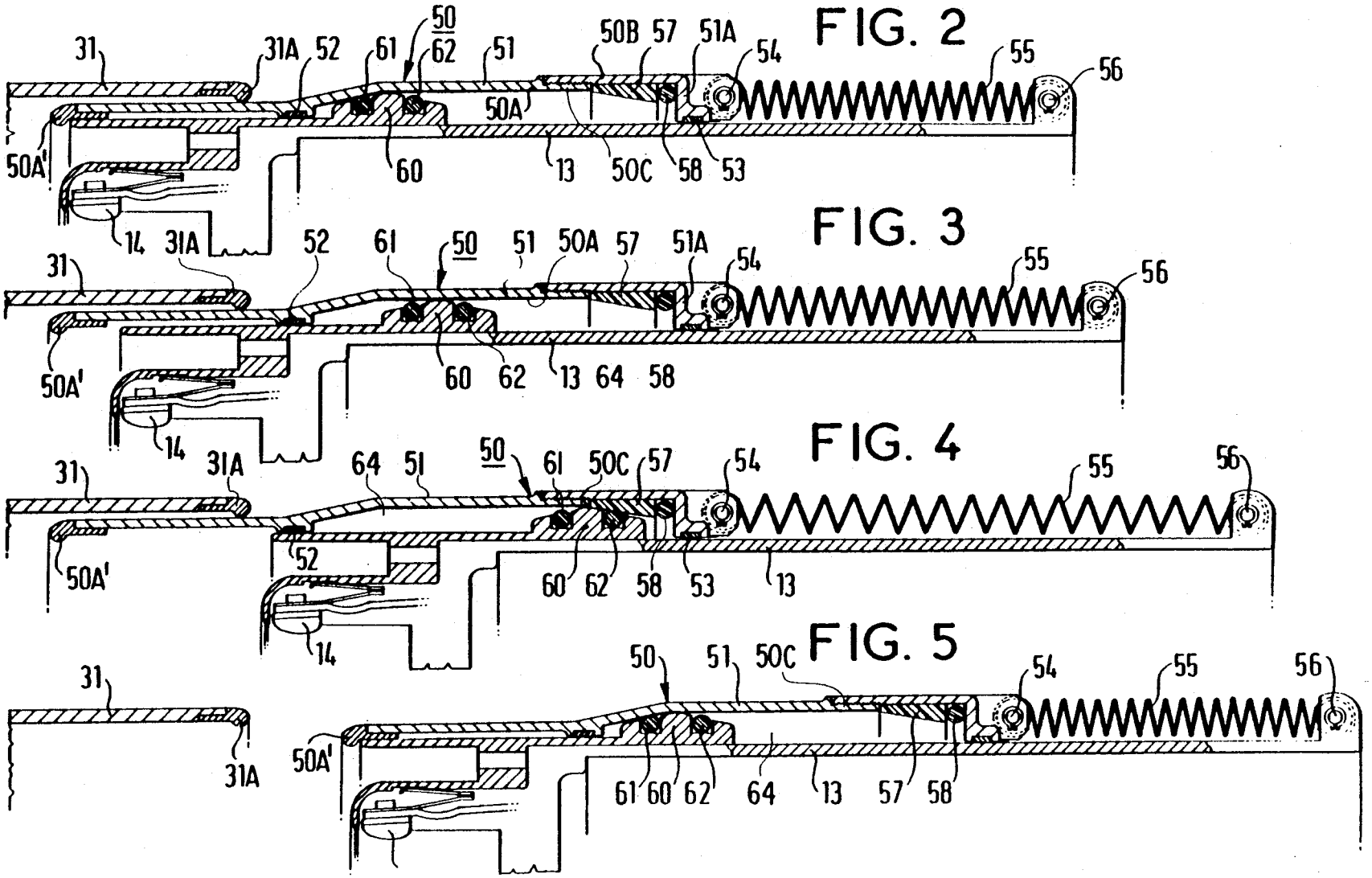
FIG. 2 is a fragmentary view in axial section of an insertion contact of the invention, shown when the circuit-breaker is in the engaged position.
FIG. 3 is a fragmentary view in axial section of the same inertia contact, shown at the beginning of a disengagement stroke of the circuit-breaker.
FIG. 4 is a fragmentary view in axial section of the same inertia contact, during a disengagement stroke of the circuit-breaker, when the moving contact of the circuit-breaker comes into contact with the inertia contact.
FIG. 5 is a fragmentary view in axial section of the same inertia contact, shown when the circuit-breaker is in the disengaged position.

The elements common to FIGS. 2 to 4 and to FIG. 1 are given the same reference numbers.

In FIGS. 2 to 4, the tube 13 carries the fingers 14 constituting the main moving contact of a circuit breaker protected by the anti-corona cap 10.

The inertia contact is designated by the overall reference 50, and is a circularly-symmetrical metal part or casing having a substantially tubular shape with a radial projection 51. At two places rings 52 and 53 on respective sides of the projection 51 cause the metal part to fit snugly against the tube 13 supporting the main contact constituted by fingers 14 for sliding engagement between the inertia contact 50 and the tube 13. At one rear end, the insertion contact has lugs 54 with first ends of coil springs 55 fixed respectively thereto. Second ends of the springs 55 are fixed to lugs 56, integral with the tube 13 at a rear end thereof. In practice, three parallel springs 55 are disposed circumferentially at 120 degrees from one another about the periphery of tube 13, each spring 55 having a weak force, e.g. about 10 daN. (deca Newton)

A band 57 is disposed inside the projection 51 with a cavity 64 defined by the projection 51 and tube 13 and at one rear end 51A thereof, the band being coaxial with the tube 13, and having a conical inside surface. The band, which is made of a synthetic material such as polytetrafluoroethylene (PTFE) adjoins an O-ring 58 made of elastomer bearing against the rear end 51A of the projection of the insertion contact 50. Advantageously, the inertia contact 50 is made in two portions 50A and 50B having mating end threads 50C enabling them to be screwed together. Band 57 is clamped between the sealing ring 58 and the shoulder constituted by the end of portion 50A.

The other end of portion 50A carries a tip 50'A made of an alloy that is resistant to the effects of arcing.

The band 57 engages with a domed collar 60 integral with the tube 13, the collar being provided with notches in which O-rings 61 and 62 are placed, the O-rings projecting slightly from the collar and being disposed in planes that are perpendicular to the axis of the inertia contact. The O-rings are preferably made of elastomer.

The inertia contact operates as follows. When the circuit-breaker is in the engaged position (FIG. 2), the end 31A of contact 31 is in fixed contact with inertia contact 50. The varistor or the resistor connected to fixed contact 31 is short-circuited because the permanent contacts of the circuit-breaker are engaged.

On circuit-breaker opening, the moving equipment including tube 13 is driven towards the right of the figure (FIG. 3), and the main circuit breaker contacts including fingers 14 move apart because of its inertia. The inertia contact 50 remains in place, in spite of being subjected to a small amount of urging from the expanding springs 55.

Since the moving equipment continues its stroke, the collar 60 comes into contact with the band 57 (FIG. 4). The shock of contact is damped by the elastomer ring 62 and by the band 67 made of PTFE which compresses the sealing ring 58. As from this instant, the inertia contact 50 is driven, to the right but the varistor or resistor component remains inserted until the end 50A' of the inertia contact 50 leaves the fixed contact of the circuit-breaker 31.

The moving equipment continues its stroke until the end point thereof (FIG. 5). The distance between contacts 50A' and 31A is sufficient to provide isolation, and to prevent any re-striking; the springs 55 bring inertia contact 50 back should it bounce at the end of the stroke.

On inertia contact closing, the varistor or resistor component is inserted as soon as contacts 50A' and 31A touch each other, and the component remains inserted until the contacts are short-circuited by contact being established between the circuit-breaker arcing contacts, (not shown). O-ring 61 serves to damp the shock of engagement between the collar 60 and portion 50A of contact 50, at the end of the disengagement stroke, when the moving tube 13 is stopped.

The inertia contact 50 of the invention is of simple and cheap construction. Its profile is well suited to the dielectric requirements inside the interrupting chamber. Its radial size is small, so that it can be installed in existing interrupting chambers.

I claim:

1. An inertia contact for engagement with a fixed contact of a circuit-breaker in series with an insertable component, such as a resistor or a varistor, disposed in an interrupting chamber of said circuit-breaker and insertion in parallel with main contacts of the circuit-breaker for a limited period of time, said circuit-breaker including a tube supporting moving contacts and connected to a drive rod, said inertia contact comprising a circularly-symmetrical metal casing coaxial with said tube and surrounding said tube, the casing being substantially tubular in shape with a radial projection flanked by two rings fitting snugly against said tube and sliding thereon, said inertia contact having a first end made of an alloy resistant to the effects of arcing, and a second end including means for fixing the inertia contact to a first end of at least one coil spring, means fixing a second end of said at least one coil spring to the end of the tube remote from said inertia contact, a band having a conical inside cross-section being disposed on the interior of said projection and at one end of a cavity, a domed collar fixed to said tube and projecting into said cavity and engagable with said band to damp the shock upon impact between the domed collar and said band as a result of relative motion of said tube during circuit-breaker opening resisted by expansion of said at least one coil spring, whereupon the tube drives the inertia contact to effect a delayed opening of the inertia contact and the fixed contact of the circuit-breaker in series with the insertable component.

2. An inertia contact according to claim 1, wherein said at least one spring comprises three parallel springs disposed at 120 degrees from one another circumferentially about said tube.

3. An inertia contact according to claim 1, wherein the domed collar carries two O-rings disposed in planes that are perpendicular to the axis of the insertion contact with said O-rings projecting outwardly of the collar and engagable with the band.

4. An inertia contact according to claim 3, wherein the O-rings are made of elastomer.

5. An inertia contact according to claim 1, wherein said band is made of a synthetic material such as polytetrafluoroethylene.

6. An inertia contact according to claim 1, wherein said metal casing comprises two portions having mating threaded ends screwed together.

7. An inertia contact according to claim 6, wherein said band is clamped between a step constituted by one of said portions and a sealing ring bearing against the end of the cavity delimited by the projection and said tube.

8. An inertia contact according to claim 7, wherein said sealing ring is made of elastomer.

* * * * *